US011326811B2

(12) United States Patent
Hirayama

(10) Patent No.: US 11,326,811 B2
(45) Date of Patent: May 10, 2022

(54) CRYOGENIC REFRIGERATOR AND HEATING METHOD FOR PULSE TUBE CRYOCOOLER

(71) Applicant: SUMITOMO HEAVY INDUSTRIES, LTD., Tokyo (JP)

(72) Inventor: Takashi Hirayama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 178 days.

(21) Appl. No.: 16/775,282

(22) Filed: Jan. 29, 2020

(65) Prior Publication Data

US 2020/0166247 A1 May 28, 2020

Related U.S. Application Data

(63) Continuation of application No. PCT/JP2018/022247, filed on Jun. 11, 2018.

(30) Foreign Application Priority Data

Aug. 1, 2017 (JP) ..... JP2017-149330

(51) Int. Cl.
*F25B 9/14* (2006.01)
*F25B 29/00* (2006.01)

(52) U.S. Cl.
CPC ..... *F25B 9/145* (2013.01); *F25B 29/00* (2013.01); *F25B 2309/1407* (2013.01); *F25B 2309/1412* (2013.01); *F25B 2309/1422* (2013.01)

(58) Field of Classification Search
CPC .. F25B 9/145; F25B 29/00; F25B 2309/1407; F25B 2309/1412; F25B 2309/1422; F25B 2309/1427; F25B 2700/2104; F25D 29/001; F25D 19/00
USPC ..... 62/6
See application file for complete search history.

(56) References Cited

U.S. PATENT DOCUMENTS

| | | | |
|---|---|---|---|
| 6,196,006 | B1 | 3/2001 | Kawano et al. |
| 2005/0126187 | A1 | 6/2005 | Li et al. |
| 2013/0247593 | A1 | 9/2013 | Hiratsuka et al. |

FOREIGN PATENT DOCUMENTS

| | | | | |
|---|---|---|---|---|
| JP | 07294037 | A * | 11/1995 | ..... F25B 9/145 |
| JP | H07294037 | A | 11/1995 | |
| JP | H08271074 | A | 10/1996 | |
| JP | H11337204 | A | 12/1999 | |
| JP | 2000310458 | A | 11/2000 | |
| JP | 2003148825 | A | 5/2003 | |

(Continued)

*Primary Examiner* — Steve S Tanenbaum
(74) *Attorney, Agent, or Firm* — HEA Law PLLC

(57) ABSTRACT

A cryogenic refrigerator includes a pulse tube cryocooler including a pulse tube, and a pulse tube cryocooler rotating mechanism that rotatably supports the pulse tube cryocooler allowing it to be changed from a cooling posture to a heating posture. When the pulse tube cryocooler is in the cooling posture, an inclination angle formed between a vertical line and a center axis of the pulse tube is a first angle, and when the pulse tube cryocooler is in the heating posture, the inclination angle is a second angle. In a case where the inclination angle formed when a cold end of the pulse tube faces vertically downward is defined as zero degrees and the inclination angle formed when the cold end of the pulse tube faces vertically upward is defined as 180 degrees, the second angle is larger than the first angle.

8 Claims, 8 Drawing Sheets

(56) References Cited

FOREIGN PATENT DOCUMENTS

| | | | |
|---|---|---|---|
| JP | 2005024184 | A | 1/2005 |
| JP | 2013194997 | A | 9/2013 |

* cited by examiner

CRYOGENIC REFRIGERATOR AND HEATING METHOD FOR PULSE TUBE CRYOCOOLER

RELATED APPLICATIONS

The contents of Japanese Patent Application No. 2017-149330, and of International Patent Application No. PCT/JP2018/022247, on the basis of each of which priority benefits are claimed in an accompanying application data sheet, are in their entirety incorporated herein by reference.

BACKGROUND

Technical Field

Certain embodiments of the present invention relate to a cryogenic refrigerator including a pulse tube cryocooler, and a heating method for a pulse tube cryocooler.

Description of Related Art

As main components, a pulse tube cryocooler generally includes an oscillating flow generation source, a regenerator, a pulse tube, and a phase control mechanism. There are several systems for generating an oscillating flow. For example, there are known a so-called a Gifford-McMahon (GM) system using a combination of a compressor and a periodic flow path switching valve, and a Stirling system for generating the oscillating flow by using a harmonically oscillating piston.

A heat exchanger which is also called a cooling stage is installed in a connection portion between cold ends of the regenerator and the pulse tube. The cooling stage is cooled to a cryogenic temperature by driving the pulse tube cryocooler. An object to be cooled is cooled as follows. The object to be cooled is thermally coupled to the cooling stage either by being directly attached to an outer surface of the cooling stage or via heat transfer member. The cooling stage is called a cold head together with the regenerator and the pulse tube.

SUMMARY

According to an aspect of the present invention, there is provided a cryogenic refrigerator including a pulse tube cryocooler including a pulse tube, and a pulse tube cryocooler rotating mechanism that rotatably supports the pulse tube cryocooler allowing it to be changed from a cooling posture to a heating posture. When the pulse tube cryocooler is in the cooling posture, an inclination angle formed between a vertical line and a center axis of the pulse tube is a first angle, and when the pulse tube cryocooler is in the heating posture, the inclination angle is a second angle. In a case where the inclination angle formed when a cold end of the pulse tube faces vertically downward is defined as zero degrees and the inclination angle formed when the cold end of the pulse tube faces vertically upward is defined as 180 degrees, the second angle is larger than the first angle.

According to another aspect of the present invention, there is provided a heating method for a pulse tube cryocooler including rotating the pulse tube cryocooler to be changed from a cooling posture to a heating posture, and heating the pulse tube cryocooler in the heating posture. When the pulse tube cryocooler is in the cooling posture, an inclination angle formed between a vertical line and a center axis of the pulse tube is a first angle, and when the pulse tube cryocooler is in the heating posture, the inclination angle is a second angle. In a case where the inclination angle formed when a cold end of the pulse tube faces vertically downward is defined as zero degrees and the inclination angle formed when the cold end of the pulse tube faces vertically upward is defined as 180 degrees, the second angle is larger than the first angle.

DETAILED DESCRIPTION

Figure 1:
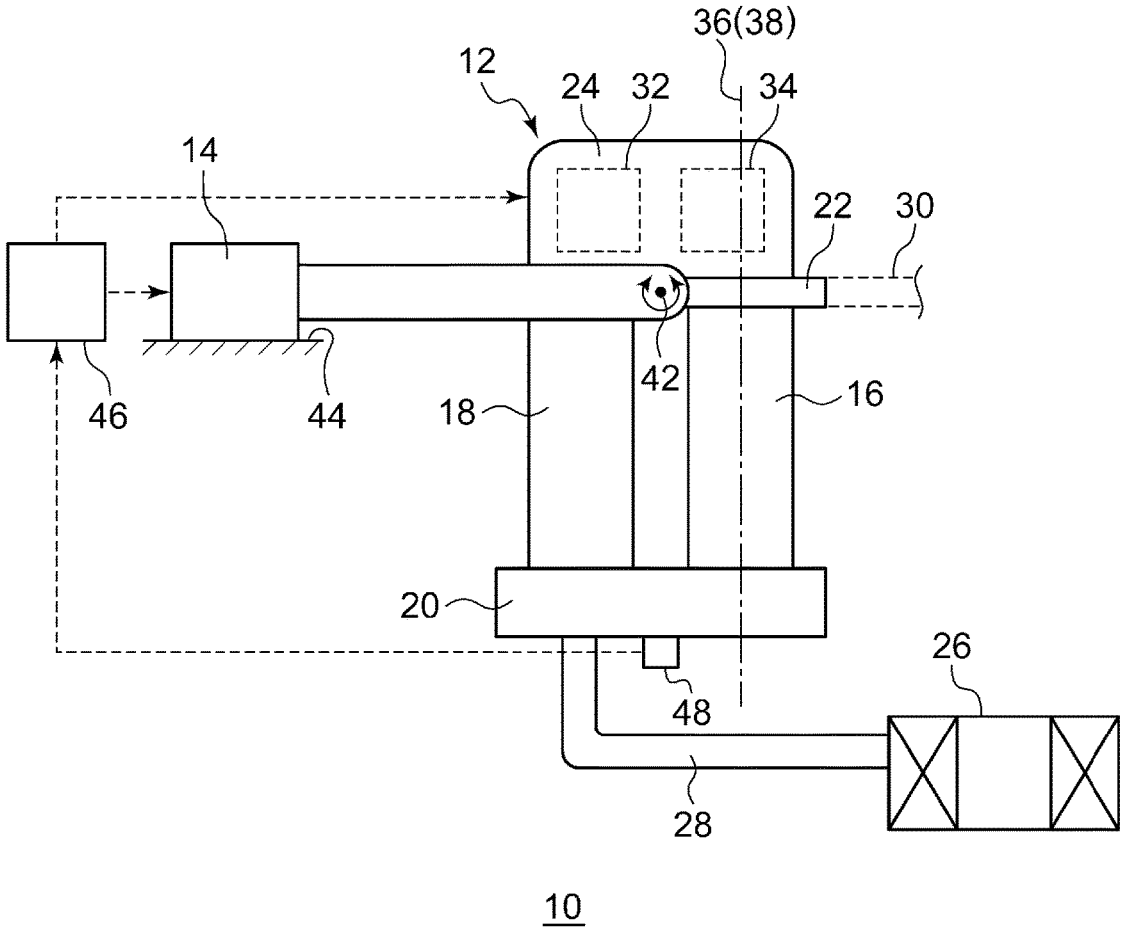
FIG. 1 is a view schematically illustrating an overall configuration of a cryogenic refrigerator according to an embodiment.

In order to easily maintain an object to be cooled at a cryogenic temperature, a cold head of a pulse tube cryocooler is generally used in a state where the cold head is accommodated in a heat insulating container together with the object to be cooled. The pulse tube cryocooler is often heated from the cryogenic temperature to a room temperature or other suitable temperatures for a maintenance purpose or other purposes. In a case of natural heating, it takes a considerable time to complete the heating.

Therefore, active heating means is typically used. For example, the cooling stage or the object to be cooled is equipped with a heating device such as an electric heater. Alternatively, in some cases, a heating medium circulating device that collects a heating medium from the heat insulating container and supplies the heating medium from the outside of the heat insulating container to the cooling stage or the object to be cooled may be installed.

However, it is essential that the heating means is thermally coupled to the cooling stage in order to realize the heating. The heating means can increase amass to be cooled during an operation of the pulse tube cryocooler, and can serve a heat entrance path from the outside of the pulse tube cryocooler during a cooling operation. Accordingly, installing the heating means may lead to an undesirable result of increasing a heat load of the pulse tube cryocooler.

According to an aspect of the present invention, it is desirable to provide a technique for heating the pulse tube cryocooler in a short time.

Any desired combinations of the above-described components or those in which the components or expressions are substituted with each other between methods, devices, or systems are also are effectively applicable as an aspect of the present invention.

According to an aspect of the present invention, the pulse tube cryocooler can be heated in a short time.

Hereinafter, embodiments for embodying the present invention will be described in detail with reference to the drawings. In the description, the same reference numerals will be given to the same elements, and repeated description will be omitted as appropriate. Configurations described below are merely examples, and do not limit the scope of the present invention in any way. In the drawings referred to in the following description, a size or a thickness of each configuration member is set to facilitate understanding of the description, and does not necessarily indicate an actual dimension and an actual ratio.

Figure 2:
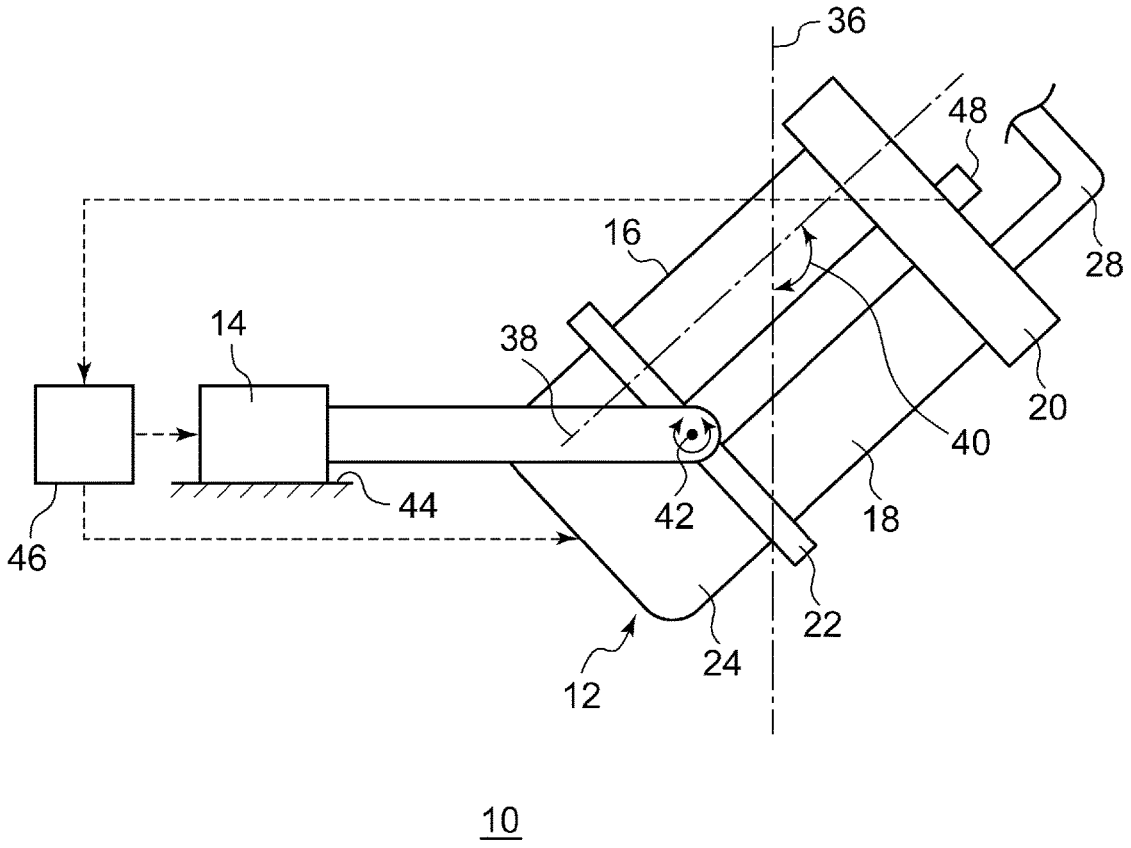
FIG. 2 is a view schematically illustrating an overall configuration of the cryogenic refrigerator according to the embodiment.

FIGS. 1 and 2 are views schematically illustrating an overall configuration of a cryogenic refrigerator 10 according to an embodiment. The cryogenic refrigerator 10 includes a pulse tube cryocooler 12 and a pulse tube cryocooler rotating mechanism 14. FIG. 1 illustrates a cooling posture of the pulse tube cryocooler 12, and FIG. 2 illustrates a heating posture of the pulse tube cryocooler 12. When cooled, the pulse tube cryocooler 12 is held by the pulse tube cryocooler rotating mechanism 14 in the cooling posture illustrated in FIG. 1. In contrast, when heated, the pulse tube cryocooler 12 is held by the pulse tube cryocooler rotating mechanism 14 in the heating posture illustrated in FIG. 2.

The pulse tube cryocooler 12 includes a pulse tube 16, a regenerator 18, a cooling stage 20, a flange portion 22, and a room temperature unit 24. The pulse tube cryocooler 12 may be a single-stage type or a multi-stage type (for example, a two-stage type).

In an exemplary configuration, the pulse tube 16 is a cylindrical tube internally having a cavity. The regenerator 18 is a cylindrical tube internally filled with a regenerator material. Both of these are adjacent to each other, and are disposed so that center axes are parallel to each other. A cold end of the pulse tube 16 and a cold end of the regenerator 18 are structurally connected and thermally coupled to each other by the cooling stage 20. The cooling stage 20 is configured to fluidly connect the cold end of the pulse tube 16 and the cold end of the regenerator 18 to each other. That is, working gas (for example, helium gas) of the pulse tube cryocooler 12 can flow through the cooling stage 20 between the cold end of the pulse tube 16 and the cold end of the regenerator 18.

An object to be cooled 26 which is a solid substance is structurally connected and thermally coupled to the cooling stage 20 by a rigid or flexible heat transfer member 28 such as a heat transfer rod. The pulse tube cryocooler 12 is configured to cool the object to be cooled 26 by means of conduction cooling. For example, the object to be cooled 26 may be a superconducting electromagnet or other superconducting devices. For example, in a case where the object to be cooled 26 is a small article such as an infrared imaging element and a sensor, the object to be cooled 26 may be directly attached to an outer surface of the cooling stage 20 without using the heat transfer member 28.

On the other hand, a hot end of the pulse tube 16 and a hot end of the regenerator 18 are connected to each other by the flange portion 22. The flange portion 22 is attached to a support portion 30 such as a support base or a support wall on which the pulse tube cryocooler 12 is installed. The support portion 30 may be a wall material or other portions of a heat insulating container or a vacuum container for accommodating the cooling stage 20 and the object to be cooled 26 (together with the pulse tube 16 and the regenerator 18).

The pulse tube 16 and the regenerator 18 extend from one main surface of the flange portion 22, and the room temperature unit 24 is provided on the other main surface of the flange portion 22. Therefore, in a case where the support portion 30 forms a portion of the heat insulating container or the vacuum container, when the flange portion 22 is attached to the support portion 30, the pulse tube 16, the regenerator 18, and the cooling stage 20 are accommodated inside the container, and the room temperature unit 24 is disposed outside the container.

The room temperature unit 24 has an oscillating flow generation source 32 and a phase control mechanism 34 of the pulse tube cryocooler 12. As is well known, in a case where the pulse tube cryocooler 12 adopts a GM type, as the oscillating flow generation source 32, a combination is used which includes a compressor that generates a steady flow of the working gas and a flow path switching valve that connects the compressor to the pulse tube 16 and the regenerator 18 by periodically switching between a high pressure side and a low pressure side of the compressor. The flow path switching valve works as the phase control mechanism 34 together with a buffer tank provided if necessary. In a case where the pulse tube cryocooler 12 is a Stirling system, as the oscillating flow generation source 32, the compressor that generates an oscillating flow by using a harmonically oscillating piston is used. As the phase control mechanism 34, a buffer tank and a communication passage that connects the buffer tank to the hot end of the pulse tube 16 are used.

The oscillating flow generation source 32 does not need be directly attached to the flange portion 22. The oscillating flow generation source 32 may be disposed separately from the cold head of the pulse tube cryocooler 12, and may be connected to the cold head by using a rigid or flexible pipe. Similarly, it is not essential that the phase control mechanism 34 is directly attached to the flange portion 22. The phase control mechanism 34 may be disposed separately from the cold head of the pulse tube cryocooler 12, and may be connected to the cold head by using the rigid or flexible pipe.

According to this configuration, the pulse tube cryocooler 12 properly delays a phase of displacement oscillation of a gas element (also called a gas piston) inside the pulse tube 16 compared to pressure oscillation of the working gas. In this manner, PV work is generated in the cold end of the pulse tube 16, thereby enabling the cooling stage 20 to be cooled. In this way, the cryogenic refrigerator 10 can cool the object to be cooled 26 by operating the pulse tube cryocooler 12.

Here, an inclination angle 40 formed between a vertical line 36 and a center axis 38 of the pulse tube 16 is considered (refer to FIG. 2). The vertical line 36 indicates a direction of gravity, and the gravity acts downward along the vertical line 36. The inclination angle 40 formed when the cold end of the pulse tube 16 faces vertically downward is defined as zero degrees, and the inclination angle 40 formed when the cold end of the pulse tube 16 faces vertically upward is defined as 180 degrees.

For convenience of description, in some cases, the inclination angle 40 formed when the pulse tube cryocooler 12 is in the cooling posture is called a first angle, and the inclination angle 40 formed when the pulse tube cryocooler 12 is in the heating posture is called a second angle. According to the present embodiment, the second angle is larger than the first angle. For example, in the cooling posture of the pulse tube cryocooler 12 illustrated in FIG. 1, the inclination angle 40, that is, the first angle is zero degrees. In the heating posture of the pulse tube cryocooler 12 illustrated in FIG. 2, the inclination angle 40, that is, the second angle is 135 degrees.

The pulse tube cryocooler rotating mechanism 14 is provided to be capable of adjusting the inclination angle 40 of the pulse tube 16. The pulse tube cryocooler rotating mechanism 14 adjusts the inclination angle 40, thereby changing the pulse tube cryocooler 12 from the cooling posture to the heating posture, or changing the pulse tube cryocooler 12 from the heating posture to the cooling posture.

The pulse tube cryocooler rotating mechanism 14 supports the pulse tube cryocooler 12 to be rotatable around about a rotation axis 42 perpendicular to the center axis 38 of the pulse tube 16. The pulse tube cryocooler rotating mechanism 14 is installed in a stationary unit 44, and can rotate the pulse tube cryocooler 12 with respect to the stationary unit 44. The support portion 30 may be attached to the stationary unit 44, or may form a portion of the stationary unit 44.

As an example, the pulse tube cryocooler rotating mechanism 14 is connected to the pulse tube cryocooler 12 to adjust the inclination angle 40 by rotating the flange portion 22 of the pulse tube cryocooler 12. However, the pulse tube cryocooler rotating mechanism 14 may be connected to the pulse tube cryocooler 12 to rotate other portions such as the room temperature unit 24 of the pulse tube cryocooler 12. The pulse tube cryocooler rotating mechanism 14 may be manually rotatable, or may include a rotation drive source such as a motor.

The pulse tube cryocooler rotating mechanism 14 may be capable of rotating the pulse tube cryocooler 12 around at least one rotation axis facing in a different direction from that of the center axis 38 of the pulse tube 16. Accordingly, the rotation axis 42 may not be perpendicular to the center axis 38 of pulse tube 16. The pulse tube cryocooler rotating mechanism 14 may be configured to rotate the pulse tube cryocooler 12 around each of two rotation axes different from that of the center axis 38 of the pulse tube 16. The two rotation axes may be the rotation axis 42 and another rotation axis perpendicular to the center axis 38 and the rotation axis 42 of the pulse tube 16. If necessary, the pulse tube cryocooler rotating mechanism 14 may be configured to enable the pulse tube cryocooler 12 to move in parallel.

The cryogenic refrigerator 10 includes a heating control unit 46 and a temperature sensor 48. The heating control unit 46 is configured to automatically control a heating method for the pulse tube cryocooler 12 according to the present embodiment. The heating control unit 46 is configured to control the pulse tube cryocooler 12 and the pulse tube cryocooler rotating mechanism 14, based on a measured temperature signal output from the temperature sensor 48.

The temperature sensor 48 is attached to the cooling stage 20. The temperature sensor 48 may be attached to the object to be cooled 26 or the heat transfer member 28. The temperature sensor 48 is configured to generate the measured temperature signal by measuring the temperature of the cooling stage 20. The temperature sensor 48 is connected to the heating control unit 46 to output the measured temperature signal to the heating control unit 46.

Figure 3:
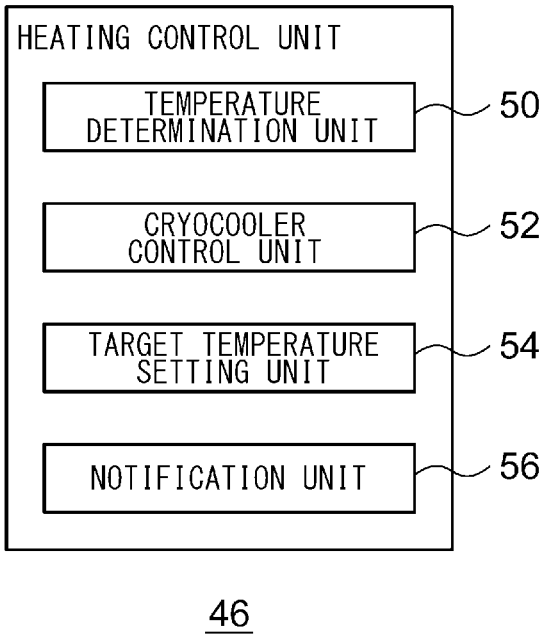
FIG. 3 is a block diagram illustrating a function and a configuration of a heating control unit according to the embodiment.

FIG. 3 is a block diagram illustrating a function and a configuration of the heating control unit 46 according to the embodiment. Each block illustrated here can be realized using hardware such as elements including a computer CPU or other mechanical devices, or can be realized using software such as a computer program. However, here, the drawing illustrates a functional block realized in cooperation therebetween. Therefore, it will be understood by those skilled in the art that these functional blocks can be realized in various forms by using a combination of the hardware and the software.

The heating control unit 46 includes a temperature determination unit 50, a cryocooler control unit 52, a target temperature setting unit 54, and a notification unit 56. For example, the heating control unit 46 may be a control circuit such as a programmable logic controller (PLC).

The temperature determination unit 50 is configured to receive the measured temperature signal output from the temperature sensor 48, and to compare the measured temperature with a target temperature (for example, a heating target temperature or an intermediate target temperature). The temperature determination unit 50 determines whether or not the measured temperature is equal to or higher than the target temperature.

The cryocooler control unit 52 is configured to control the cryogenic refrigerator 10. For example, the cryocooler control unit 52 is configured to receive a heating start command generated in accordance with an input from a user, and to stop the operation of the pulse tube cryocooler 12. The cryocooler control unit 52 is configured to control the pulse tube cryocooler rotating mechanism 14 so as to adjust the inclination angle 40 of the pulse tube 16.

The target temperature setting unit 54 is configured to set the heating target temperature and the intermediate target temperature in accordance with the input from the user, for example. The heating target temperature and the intermediate target temperature may be set in advance as specifications of the cryogenic refrigerator according to the present embodiment.

According to the present embodiment, the pulse tube cryocooler 12 is heated without using an active heating device such as an electric heater. Accordingly, the heating target temperature is set to be equal to or lower than an ambient temperature (for example, a room temperature). The heating target temperature is higher than an initial temperature which is a cryogenic temperature. The intermediate target temperature is set between the initial temperature and the heating target temperature. As will be described later, the intermediate target temperature is set to be equal to or lower than an ultimate cooling temperature of the cooling stage 20 which can be obtained when the pulse tube cryocooler 12 is operated in the heating posture. The initial temperature is the temperature of the cooling stage 20 when the operation of the pulse tube cryocooler 12 is stopped (that is, when the heating starts), and corresponds to the ultimate cooling temperature of the cooling stage 20 which can be obtained when the pulse tube cryocooler 12 is operated in the cooling posture.

The notification unit 56 is configured to notify a user that the pulse tube cryocooler 12 is completely heated, for example, by using an image display or an audio output. The notification unit 56 notifies the user that the pulse tube cryocooler 12 is completely heated, in a case where the temperature determination unit 50 determines that the measured temperature of the temperature sensor 48 reaches the heating target temperature. The notification unit 56 may notify the user of the fact, in a case where the temperature determination unit 50 determines that the measured temperature of the temperature sensor 48 reaches the intermediate target temperature.

Figure 4:
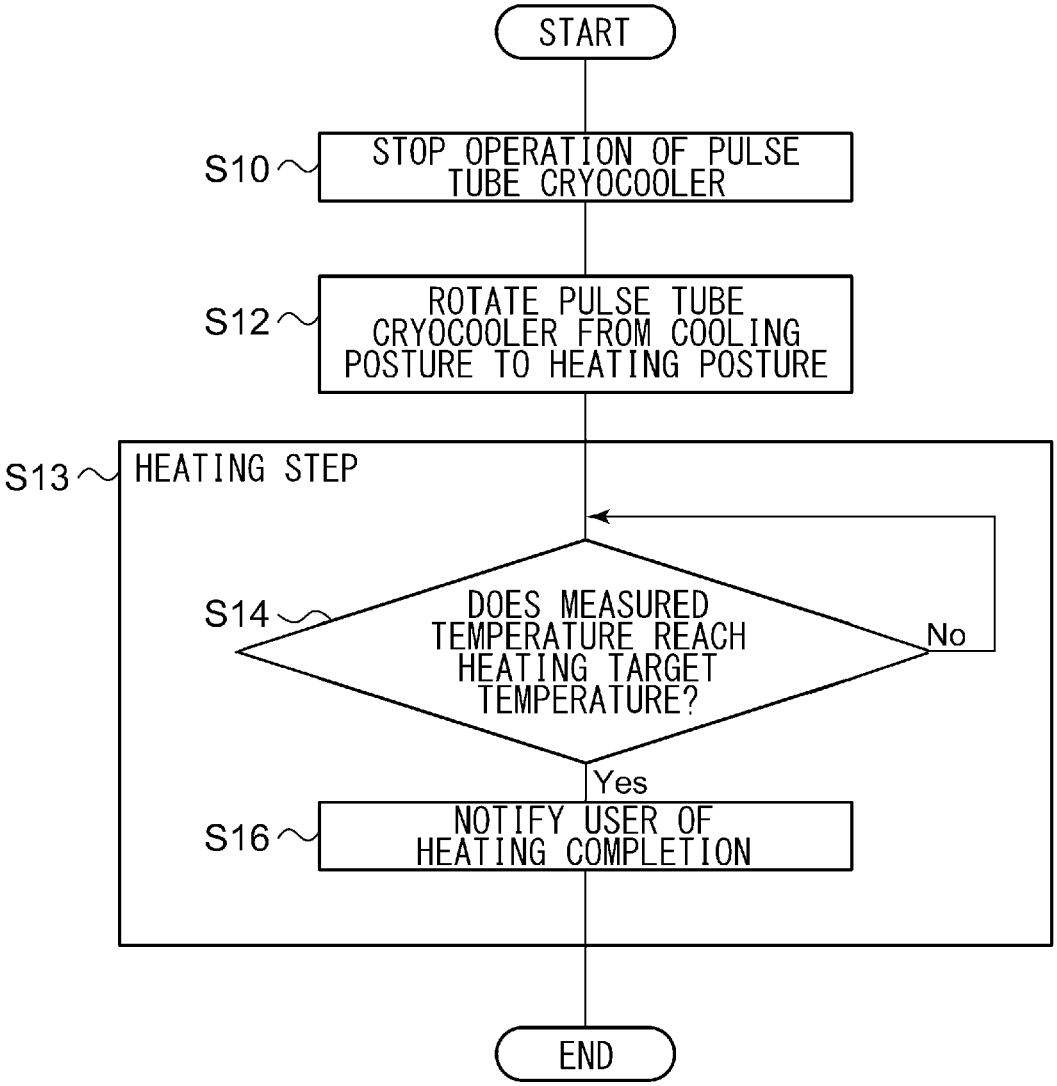
FIG. 4 is a flowchart illustrating a heating process of the cryogenic refrigerator according to the embodiment.

FIG. 4 is a flowchart illustrating a heating process of the cryogenic refrigerator 10 according to the embodiment. Before the heating process starts, the pulse tube cryocooler 12 is operated in a state where the pulse tube cryocooler 12 is held in the cooling posture by the pulse tube cryocooler rotating mechanism 14. Accordingly, the cooling stage 20 and the object to be cooled 26 are cooled to a desired cryogenic temperature.

The cryocooler control unit 52 receives a heating start command, and stops the operation of the pulse tube cryocooler 12 (S10). The cryocooler control unit 52 drives the pulse tube cryocooler rotating mechanism 14, and rotates the pulse tube cryocooler 12 so that the pulse tube cryocooler 12 is changed from the cooling posture to the heating posture (S12). At this time point, the cooling stage 20 has the initial temperature. Thereafter, the pulse tube cryocooler 12 is heated in the heating posture (S13). Until the pulse tube cryocooler 12 is completely heated, the pulse tube cryocooler 12 is held in the heating posture in a state where the operation is stopped.

In a heating step (S13) of the pulse tube cryocooler 12, the temperature determination unit 50 determines whether or not the measured temperature of the temperature sensor 48 reaches the heating target temperature (S14). In a case where the measured temperature of the temperature sensor 48 does not reach the heating target temperature, that is, in a case where the measured temperature is lower than the heating target temperature (No in S14), the temperature determination unit 50 waits for a while, and determines again whether or not the measured temperature of the temperature sensor 48 reaches the heating target temperature (S14).

In a case where the measured temperature of the temperature sensor 48 reaches the heating target temperature, that is, in a case where the measured temperature is equal to or higher than the heating target temperature (Yes in S14), the notification unit 56 notifies a user that the pulse tube cryocooler 12 is completely heated (S16). In this way, the heating process is completed.

Figure 5:
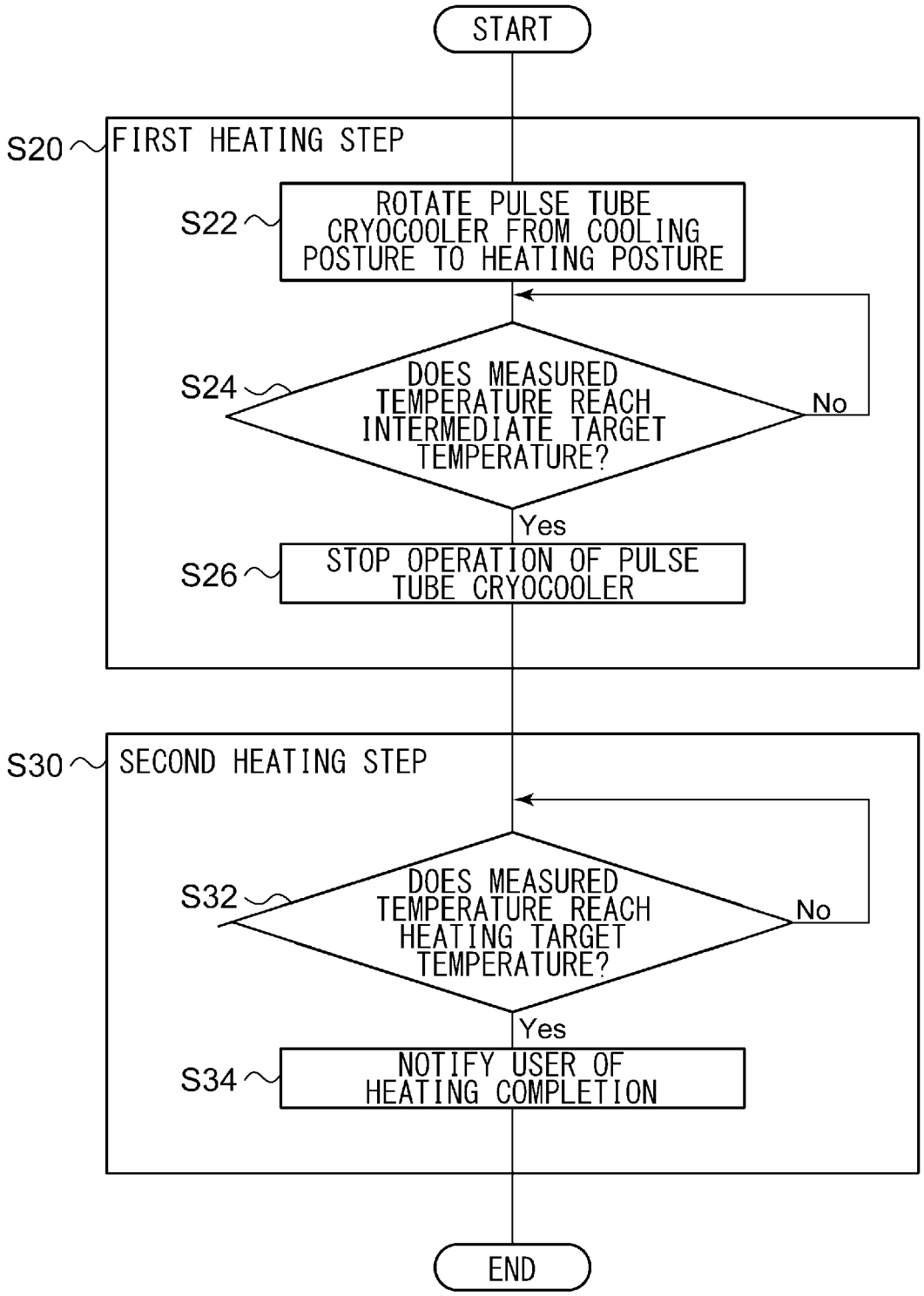
FIG. 5 is a flowchart illustrating a heating process of a cryogenic refrigerator according to another embodiment.

FIG. 5 is a flowchart illustrating a heating process of the cryogenic refrigerator 10 according to another embodiment. Before the heating process starts, the pulse tube cryocooler 12 is operated in a state where the pulse tube cryocooler 12 is held in the cooling posture by the pulse tube cryocooler rotating mechanism 14. Accordingly, the cooling stage 20 and the object to be cooled 26 are cooled to a desired cryogenic temperature.

The heating process illustrated in FIG. 5 includes a first heating step (S20) and a second heating step (S30). The heating control unit 46 first performs the first heating step, and thereafter performs the second heating step.

In the first heating step (S20), the heating control unit 46 operates the pulse tube cryocooler 12 in the heating posture until the pulse tube cryocooler 12 is heated to the intermediate target temperature preset between the initial temperature and the heating target temperature.

When receiving the heating start command, the cryocooler control unit 52 drives the pulse tube cryocooler rotating mechanism 14, and rotates the pulse tube cryocooler 12 so that the pulse tube cryocooler 12 is changed from the cooling posture to the heating posture (S22). In this case, the pulse tube cryocooler 12 is continuously operated. Thereafter, the pulse tube cryocooler 12 is heated in the heating posture.

The temperature determination unit 50 determines whether or not the measured temperature of the temperature sensor 48 reaches the intermediate target temperature (S24). In a case where the measured temperature of the temperature sensor 48 does not reach the intermediate target temperature, that is, in a case where the measured temperature is lower than the intermediate target temperature (No in S24), the temperature determination unit 50 waits for a while, and determines again whether or not the measured temperature of the temperature sensor 48 reaches the intermediate target temperature (S24).

In a case where the measured temperature of the temperature sensor 48 reaches the intermediate target temperature, that is, in a case where the measured temperature is equal to or higher than the intermediate target temperature (Yes in S24), the cryocooler control unit 52 stops the operation of the pulse tube cryocooler 12 (S26), and the process proceeds to the second heating step (S30).

In the second heating step (S30), the temperature determination unit 50 determines whether or not the measured temperature of the temperature sensor 48 reaches the heating target temperature (S32). In a case where the measured temperature of the temperature sensor 48 does not reach the heating target temperature, that is, in a case where the measured temperature is lower than the heating target temperature (No in S32), the temperature determination unit 50 waits for awhile, and determines again whether or not the measured temperature of the temperature sensor 48 reaches the heating target temperature (S32).

In a case where the measured temperature of the temperature sensor 48 reaches the heating target temperature, that is, in a case where the measured temperature is equal to or higher than the heating target temperature (Yes in S32), the notification unit 56 notifies the user that the pulse tube cryocooler 12 is completely heated (S34). In this way, the heating process is completed.

In the embodiment, the heating method for the cryogenic refrigerator 10 may be manually performed. It is not essential to automatically control the heating method. In this case, the cryogenic refrigerator 10 may not include the heating control unit 46.

After the heating process is completed, the pulse tube cryocooler 12 may be subjected to maintenance work such as component operation checking and consumable component replacement. When the maintenance work is completed, the pulse tube cryocooler rotating mechanism 14 returns the pulse tube cryocooler 12 to the cooling posture. The operation of the pulse tube cryocooler 12 starts again, and the pulse tube cryocooler 12 is cooled again.

Figure 6:
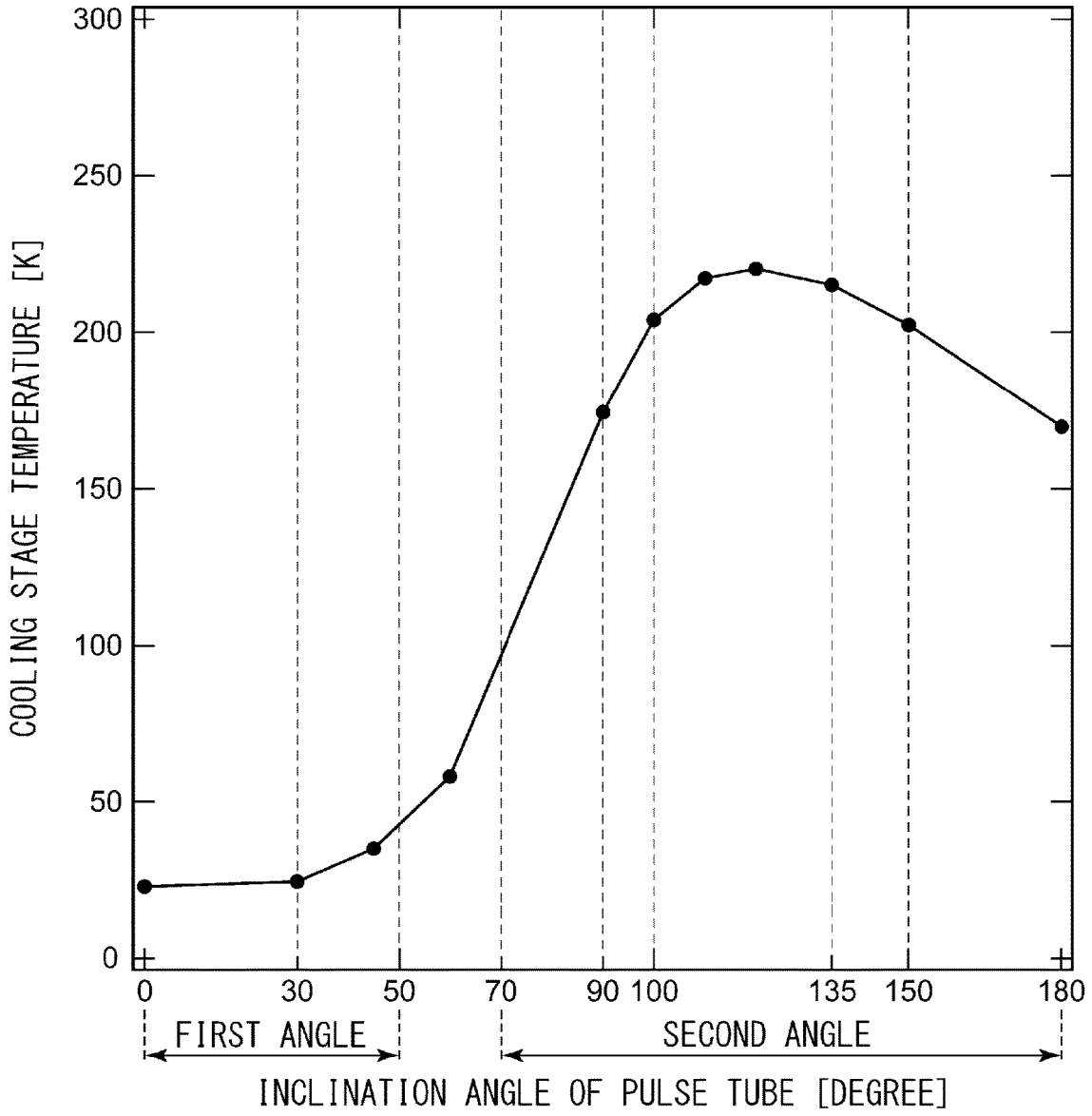
FIG. 6 is a graph illustrating direction dependency of an ultimate cooling temperature during an operation of a pulse tube cryocooler according to the embodiment.

FIG. 6 is a graph illustrating direction dependency of the ultimate cooling temperature during the operation of the pulse tube cryocooler 12 according to the embodiment. A vertical axis in FIG. 6 represents the temperature of the cooling stage 20 (temperature of a first-stage cooling stage), and a horizontal axis represents the inclination angle 40. The illustrated graph shows a temperature measurement result of the first-stage cooling stage in a two-stage type cryocooler.

The ultimate cooling temperature of the pulse tube cryocooler 12 depends on the inclination angle 40 of the pulse tube 16. As the inclination angle 40 decreases, the ultimate temperature tends to be lower. As the inclination angle 40 increases, the ultimate temperature tends to be higher.

A main factor in this tendency is an effect of natural convection of the working gas generated inside the pulse tube 16. In a case where the inclination angle 40 is small, for example, in a case where the inclination angle 40 is zero degrees, the cold end of the pulse tube 16 faces vertically downward, and the hot end of the pulse tube 16 faces vertically upward. The posture in this case corresponds to the cooling posture illustrated in FIG. 1. The cold working gas cooled by the cold end of the pulse tube 16 relatively stably stays below (that is, the cold end) due to the action of gravity. The natural convection is less likely to occur inside the pulse tube 16. Therefore, the cooling stage 20 can be maintained at a low temperature. As illustrated in FIG. 6, in a case where the inclination angle 40 falls within 50 degrees, the cooling stage 20 can be maintained at the lowest temperature.

On the other hand, in a case where the inclination angle 40 is large, the pulse tube 16 is disposed horizontally or substantially horizontally. In a case where the inclination angle 40 is larger, the cold end of the pulse tube 16 is located above the hot end. The posture in this case corresponds to the heating posture illustrated in FIG. 2. In this case, the natural convection is likely to occur inside the pulse tube 16 due to the action of gravity. The cold working gas cooled by the cold end of the pulse tube 16 is mixed with the hot working gas present in the hot end of the pulse tube 16. As a result, lowering the temperature of the cooling stage 20 is suppressed, and the ultimate temperature becomes higher. This means the following. When the pulse tube cryocooler 12 is operated in a state where the inclination angle 40 of the pulse tube 16 is large, the cooling stage 20 can be maintained at a relatively high temperature.

It can be inferred that the ultimate cooling temperature illustrated as an example in FIG. 6 indicates a degree of the natural convection induced inside the pulse tube 16 depending on the posture of the pulse tube cryocooler 12. If the ultimate temperature is low, it is considered that the natural convection inside the pulse tube 16 is negligible or small. On the other hand, if the ultimate temperature is high, it is considered that the natural convection is remarkably induced inside the pulse tube 16.

Therefore, in a case where the pulse tube cryocooler 12 is cooled, it is advantageous that the inclination angle 40 is small. In contrast, in a case where the pulse tube cryocooler 12 is heated, it is advantageous that the inclination angle 40 is large.

The first angle that determines the cooling posture of the pulse tube cryocooler 12 is determined so that the natural convection of the working gas is not induced inside the pulse tube 16 or so that the natural convection inside the pulse tube 16 is sufficiently suppressed. For example, the first angle is selected from a range of zero degrees to 50 degrees, and is preferably selected from a range of zero degrees to 30 degrees. More preferably, the first angle is zero degrees. According to this configuration, the ultimate cooling temperature during the operation of the pulse tube cryocooler 12 can be maintained to be sufficiently low.

The second angle that determines the heating posture of the pulse tube cryocooler 12 is determined so as that the natural convection of the working gas is induced inside the pulse tube 16. For example, the second angle is selected from a range of 70 degrees to 180 degrees, and is preferably selected from a range of 90 degrees to 150 degrees. More preferably, the second angle is selected from a range of 100 degrees to 135 degrees. According to this configuration, the pulse tube cryocooler 12 can be quickly heated by using the natural convection. For example, when the operation of the pulse tube cryocooler 12 is stopped to carry out the maintenance work for the pulse tube cryocooler 12, the pulse tube cryocooler 12 can be quickly heated.

Figure 7:
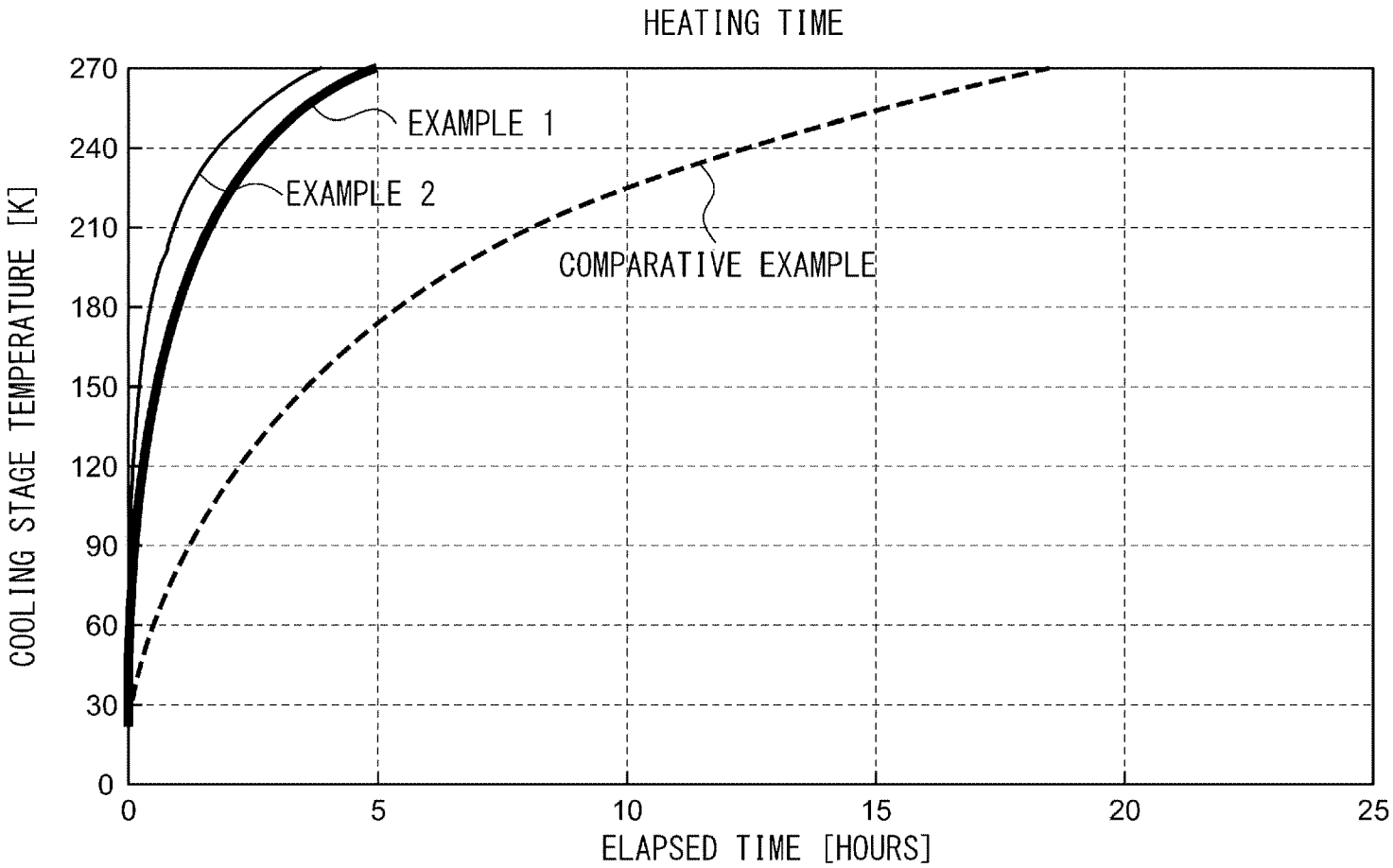
FIG. 7 is a graph illustrating a heating time of the pulse tube cryocooler according to the embodiment.

FIG. 7 is a graph illustrating a heating time of the pulse tube cryocooler 12 according to the embodiment. The vertical axis in FIG. 7 represents the temperature of the cooling stage 20 (temperature of the first-stage cooling stage), and the horizontal axis represents a time elapsed from when the heating starts. The illustrated graph shows temperature measurement results of Example 1, Example 2, and a comparative example. In each example, temperature transition is measured by bringing the pulse tube cryocooler 12 into a no-load state (that is, in a state where the object to be cooled 26 is not attached to the cooling stage 20).

The comparative example shows a case where the pulse tube cryocooler 12 is naturally heated by being held in the cooling posture. In the comparative example, the operation of the pulse tube cryocooler 12 is stopped, and the pulse tube cryocooler 12 is left in a stopped state. The inclination angle 40 of the cooling posture is zero degrees. A required heating time from the initial temperature (approximately 20 K in FIG. 7) which is the cryogenic temperature to the heating target temperature (approximately 270 K in FIG. 7) is approximately 18.5 hours.

Example 1 shows a case where the pulse tube cryocooler 12 is heated using convection generated inside the pulse tube cryocooler 12 in a state where the pulse tube cryocooler 12 is held in the heating posture. In Example 1, the operation of the pulse tube cryocooler 12 is stopped. The pulse tube cryocooler 12 is changed from the cooling posture to the heating posture by the pulse tube cryocooler rotating mechanism 14, and the pulse tube cryocooler 12 is left in the stopped state. The inclination angle 40 of the heating posture is 120 degrees. The required heating time from the initial temperature to the heating target temperature is approximately 4.9 hours.

According to Example 1, the operation of the pulse tube cryocooler 12 is stopped, and the pulse tube cryocooler 12 is held in an inclined state. In this manner, the pulse tube cryocooler 12 is heated in a remarkably shorter time, compared to the comparative example. As described above, it is understood that the reason is the effect of the natural convection induced inside the pulse tube 16.

Example 1 shows a result of manually performing the heating method. However, even in a case of performing the heating process illustrated in FIG. 4, the same result as that of Example 1 is obtained.

Example 2 shows a case where the pulse tube cryocooler 12 is heated using the convection generated inside the pulse tube cryocooler 12 in a state where the pulse tube cryocooler 12 is held in the heating posture. However, Example 2 is different from Example 1 in that the pulse tube cryocooler 12 is operated in an initial heating stage and the pulse tube cryocooler 12 is stopped during the heating.

In Example 2, while the pulse tube cryocooler 12 is operated, the pulse tube cryocooler 12 is changed from the cooling posture to the heating posture by the pulse tube cryocooler rotating mechanism 14. The pulse tube cryocooler 12 is operated in the heating posture until the pulse tube cryocooler 12 is heated to the intermediate target temperature (approximately 200 K in FIG. 7). The operation of the pulse tube cryocooler 12 is stopped at the intermediate target temperature. Thereafter, the pulse tube cryocooler 12 is left while the pulse tube cryocooler 12 is held in the heating posture. The inclination angle 40 of the heating posture is 120 degrees. The required heating time from the initial temperature to the heating target temperature is approximately 3.85 hours.

According to Example 2, the pulse tube cryocooler 12 is stopped after being operated for a prescribed period of time in an inclined state, and the pulse tube cryocooler 12 is held in the inclined state. In this manner, the pulse tube cryocooler 12 is heated in a much shorter time, compared to Example 1. The reason is considered as follows. In addition to the natural convection, forced convection is induced inside the pulse tube 16 by operating the pulse tube cryocooler 12.

Example 2 shows a result of manually performing the heating method. However, even in a case of performing the heating process illustrated in FIG. 5, the same result as that of Example 2 is obtained.

In this way, the cryogenic refrigerator 10 according to the present embodiment can heat the pulse tube cryocooler 12 in a short time. The pulse tube cryocooler 12 adopts a simple method of changing the posture of the pulse tube cryocooler 12. In this manner, the time for heating the pulse tube cryocooler 12 can be remarkably shortened by using the convection (for example, the natural convection or the forced convection) of the working gas which is generated inside the pulse tube cryocooler 12.

The cryogenic refrigerator 10 according to the present embodiment can quickly heat the pulse tube cryocooler 12 without using the active heating device for heating the pulse tube cryocooler 12 (for example, the electric heater for heating the cooling stage 20 or the heating medium circulating device for heating the object to be cooled 26). Therefore, the cryogenic refrigerator 10 does not need to include the heating device configured in this way. There is an advantage that the configuration of the cryogenic refrigerator 10 can be further simplified. Since there is no heating device, a thermal load on the pulse tube cryocooler 12 is reduced. Accordingly, the cryogenic refrigerator 10 can adopt the pulse tube cryocooler 12 having a smaller size. It is possible to eliminate a risky possibility that the pulse tube cryocooler 12 may be excessively heated in a case of using the heating device.

Figure 8:
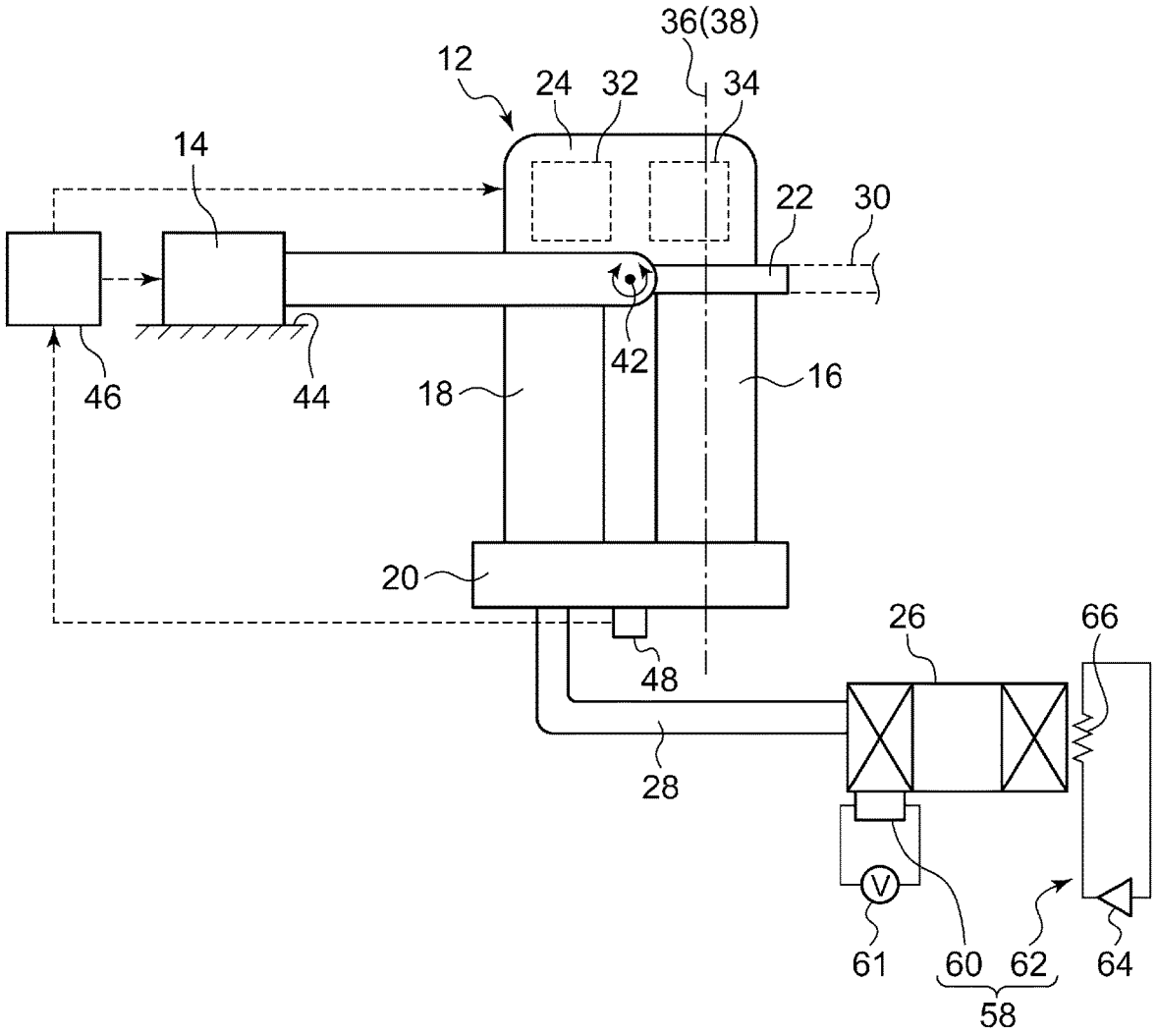
FIG. 8 is a view schematically illustrating an overall configuration of a cryogenic refrigerator according to another embodiment.

FIG. 8 is a view schematically illustrating an overall configuration of the cryogenic refrigerator 10 according to another embodiment. The cryogenic refrigerator 10 illustrated in FIG. 8 is common to the cryogenic refrigerator 10 illustrated in FIGS. 1 and 2 except for the heating means for heating the pulse tube cryocooler 12. Hereinafter, different configurations between the two will be mainly described, and common configurations will be briefly described, or description thereof will be omitted.

The cryogenic refrigerator 10 may include an active heating device 58. The active heating device 58 may include at least one of an electric heater 60 and a heating medium circulating device 62. The heating control unit 46 may be configured to control the active heating device 58 in order to heat the pulse tube cryocooler 12.

The electric heater 60 is attached to the object to be cooled 26, and heats the object to be cooled 26. Electric power is supplied to the electric heater 60 from a heater power source 61. The electric heater 60 may be attached to the cooling stage 20 or the heat transfer member 28.

The heating medium circulating device 62 is configured to supply and collect a heating medium to the cooling stage 20 or the object to be cooled 26. The heating medium circulating device 62 includes a pump 64 for feeding the collected medium, and a pipe unit including a heat exchange unit 66 thermally coupled to the cooling stage 20 or the object to be cooled 26. The heating medium flows into the pipe unit from the pump 64, and is collected to the pump 64 by way of the heat exchange unit 66. The heating medium flowing through the heat exchange unit 66 exchanges heat with the cooling stage 20 or the object to be cooled 26. In this manner, the cooling stage 20 or the object to be cooled 26 can be heated. The heat exchange unit 66 may include a coil-shaped pipe wound around the cooling stage 20 or the object to be cooled 26.

According to this configuration, the pulse tube cryocooler 12 is heated by the active heating device 58, and the convection of the working gas which is generated inside the pulse tube cryocooler 12 are used in conjunction with each other. Accordingly, the pulse tube cryocooler 12 can be heated at a higher speed.

Hitherto, the present invention has been described with reference to the examples. The present invention is not limited to the above-described embodiments, and design can be changed in various ways. It will be understood by those skilled in the art that various modification examples can be adopted and the modification examples also fall within the scope of the present invention.

In the above-described embodiment, the heating posture of the pulse tube cryocooler 12 is fixed at a prescribed inclination angle. However, this is not necessarily essential. The heating posture may be changed as appropriate when the heating method is performed. That is, the pulse tube cryocooler rotating mechanism 14 may change the inclination angle of the pulse tube 16 when the pulse tube cryocooler 12 is heated. Even in this case, as in the above-described embodiment, the pulse tube cryocooler 12 can be heated in a short time by using the convection of the working gas.

The present invention is applicable to a field of the cryogenic refrigerator including the pulse tube cryocooler and the heating method for the pulse tube cryocooler.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

a pulse tube cryocooler including a pulse tube; and a pulse tube cryocooler rotating mechanism that rotatably supports the pulse tube cryocooler allowing it to be changed from a cooling posture to a heating posture, wherein when the pulse tube cryocooler is in the cooling posture, an inclination angle formed between a vertical line and a center axis of the pulse tube is a first angle, and when the pulse tube cryocooler is in the heating posture, the inclination angle is a second angle, wherein in a case where the inclination angle formed when a cold end of the pulse tube faces vertically downward is defined as zero degrees and the inclination angle formed when the cold end of the pulse tube faces vertically upward is defined as 180 degrees, the second angle is larger than the first angle; and wherein in the heating posture, the pulse tube cryocooler is heated.

2. The cryogenic refrigerator according to claim 1, wherein the second angle is selected from a range of 70 degrees to 180 degrees.

3. The cryogenic refrigerator according to claim 1, wherein the second angle is selected from a range of 90 degrees to 150 degrees.

4. The cryogenic refrigerator according to claim 1, further comprising:

a heating controller configured to control the pulse tube cryocooler and the pulse tube cryocooler rotator based on a measured temperature of the cryocooler, wherein the heating controller is further configured to:

operate the pulse tube cryocooler and drive the pulse tube cryocooler rotator such that the pulse tube cryocooler is in the heating posture to heat the pulse tube cryocooler from an initial cryogenic temperature to an intermediate heating target temperature, stop the operation of the pulse tube cryocooler when the measured temperature reaches the intermediate heating target temperature and set the pulse tube cryocooler rotator to the heating posture to heat the pulse tube cryocooler from the intermediate heating target temperature to a final heating target temperature.

5. The cryogenic refrigerator according to claim 1, wherein in the heating posture, convection occurs in the pulse tube.

6. A heating method for a pulse tube cryocooler, comprising:

rotating the pulse tube cryocooler to be changed from a cooling posture to a heating posture; and heating the pulse tube cryocooler in the heating posture, wherein when the pulse tube cryocooler is in the cooling posture, an inclination angle formed between a vertical line and a center axis of a pulse tube is a first angle, and when the pulse tube cryocooler is in the heating posture, the inclination angle is a second angle, wherein in a case where the inclination angle formed when a cold end of the pulse tube faces vertically downward is defined as zero degrees and the inclination angle formed when the cold end of the pulse tube faces vertically upward is defined as 180 degrees, the second angle is larger than the first angle; and wherein in the heating posture, the pulse tube cryocooler is heated.

7. A cryogenic refrigerator comprising:

a pulse tube cryocooler including a pulse tube; and a pulse tube cryocooler rotating mechanism comprising a motor that rotatably supports the pulse tube cryocooler allowing it to be changed from a cooling posture to a heating posture, wherein when the pulse tube cryocooler is in the cooling posture, an inclination angle formed between a vertical line and a center axis of the pulse tube is a first angle, and when the pulse tube cryocooler is in the heating posture, the inclination angle is a second angle, wherein in a case where the inclination angle formed when a cold end of the pulse tube faces vertically downward is defined as zero degrees and the inclination angle formed when the cold end of the pulse tube faces vertically upward is defined as 180 degrees, the second angle is larger than the first angle; and wherein in the heating posture, the pulse tube cryocooler is heated.

8. The cryogenic refrigerator according to claim 7, wherein in the heating posture, convection occurs in the pulse tube.

* * * * *